US011576457B2

(12) United States Patent
Stevens

(10) Patent No.: US 11,576,457 B2
(45) Date of Patent: Feb. 14, 2023

(54) FACE AND NECK COVER WITH DROPLET FILTER

(71) Applicant: Nathaniel D. Stevens, Chula Vista, CA (US)

(72) Inventor: Nathaniel D. Stevens, Chula Vista, CA (US)

( * ) Notice: Subject to any disclaimer, the term of this patent is extended or adjusted under 35 U.S.C. 154(b) by 462 days.

(21) Appl. No.: 16/930,097

(22) Filed: Jul. 15, 2020

(65) Prior Publication Data

US 2022/0015491 A1 Jan. 20, 2022

(51) Int. Cl.

| | |
|---|---|
| ***A42B 3/28*** | (2006.01) |
| ***A41D 13/11*** | (2006.01) |
| ***A62B 18/02*** | (2006.01) |
| ***A62B 23/02*** | (2006.01) |

(52) U.S. Cl.

CPC ..... *A42B 3/28* (2013.01); *A41D 13/1107* (2013.01); *A41D 13/1161* (2013.01); *A41D 13/1192* (2013.01); *A62B 18/02* (2013.01); *A62B 23/025* (2013.01)

(58) Field of Classification Search

CPC ..... A41D 13/1107; A41D 13/1161; A41D 13/1192; A41D 15/002; A41D 23/00; A41D 27/20; A41D 13/1115; A42B 3/28; B32B 1/08; B32B 7/05; B32B 37/12; B32B 3/04; B32B 2305/18; D03D 11/02; D10B 2509/00; D10B 2505/04

See application file for complete search history.

(56) References Cited

U.S. PATENT DOCUMENTS

2012/0030859 A1* 2/2012 Kroese ..... D04B 1/22 2/207
2016/0213959 A1* 7/2016 Barklow ..... A41D 13/1107

OTHER PUBLICATIONS

BabeCloth, Internet Web Page at address https://babecloth.com/collections/bandanas, original publication date unknown, pp. 7 and 8 of pdf file are representative.
Dato, V.M. et al., Simple Respiratory Mask, Centers for Disease Control and Prevention, original publication date unknown.
Homemade Cloth Face Masks, authors and original publication date unknown, University of Utah publication.

* cited by examiner

*Primary Examiner* — Samchuan C Yao
*Assistant Examiner* — Yurie Hong
(74) *Attorney, Agent, or Firm* — GSS Law Group; Gregory S. Smith; Phillip M. Wagner

(57) ABSTRACT

A face and neck cover includes a fabric tube having an inner surface and a droplet filter attached to the inner surface. The droplet filter includes a first filter layer, a second filter layer joined to the first filter layer along a first fold, and a third filter layer joined to the first filter layer along a second fold. The third filter layer is in contact with the inner surface of the fabric tube. A first filter pocket for holding an optional removable filter medium is formed between the second filter layer and the third filter layer. A second filter pocket is formed between the third filter layer and the inner surface of the fabric tube. The first, second, and third filter layers are preferably integrally formed from one continuous sheet of fabric folded and attached to the fabric tube.

12 Claims, 7 Drawing Sheets

ALTERNATE
SECTION A - A

SECTION A - A

ALTERNATE
SECTION A - A

FACE AND NECK COVER WITH DROPLET FILTER

FIELD OF THE INVENTION

Embodiments are related to face masks with air filters for removing solid particles and/or liquid droplets.

BACKGROUND

A cloth face covering worn over the nose and mouth provides a barrier to respiratory droplets released when a person coughs, sneezes, or talks. The Centers for Disease Control and Prevention (CDC) has announced that cloth face coverings impede the transmission of coronavirus from one person to another. The CDC has recommended that all people over the age of two years should wear a cloth face covering when around people outside their household to prevent the spread of COVID-19, particularly in situations where social distancing is difficult to maintain. The CDC further recommends that cloth face coverings preferably completely cover the nostrils and mouth, fitting under the chin and over the top of the nose and snugly against the sides of the face.

SUMMARY

An example embodiment of a face and neck cover includes a fabric tube having an inner surface and a droplet filter attached to the inner surface. The droplet filter includes a first filter layer, a second filter layer joined to the first filter layer along a first fold, a third filter layer joined to the first filter layer along a second fold with the second filter layer intervening between the first filter layer and the third filter layer. The droplet filter is attached to the fabric tube with the third filter layer in contact with the inner surface of the fabric tube. The droplet filter further includes a first filter pocket formed between the second filter layer and the third filter layer. The first filter pocket extends from the first fold to the second fold. The droplet filter further includes a second filter pocket formed between the third filter layer and the inner surface of the fabric tube. The first, second, and third filter layers are preferably integrally formed segments of a fabric panel. In some embodiments, the said second fold is near an opposite end of the second filter layer from the first fold.

An embodiment of a face and neck cover optionally includes the first filter layer attached to the second filter layer, the third filter layer, and the fabric tube along a first line of attachment and along a second line of attachment, with the first line of attachment positioned near a first side of the droplet filter, and the second line of attachment positioned on a second side of the droplet filter laterally opposite the first side of the droplet filter, and further with the third filter layer attached to the fabric tube along a third line of attachment. The third line of attachment is preferably positioned along a side of the droplet filter connecting the first side of the droplet filter to the second side laterally opposite the first side.

A removable filter material may optionally be positioned in the first filter pocket and/or the second filter pocket.

The fabric tube may optionally be formed with two hearing apertures. Two mesh fabric ear covers may optionally be attached to the fabric tube, one of each of the ear covers over a separate one of the hearing apertures. The fabric tube may optionally include two attached suspension bands, one of each of the suspension bands over a separate one of the hearing apertures.

Some embodiments of the fabric tube include a top edge and a bottom edge separated from the top edge by a first cover dimension selected to position the top edge on top of a person's nose above the nostrils and the bottom edge below the person's chin. Some embodiments of the fabric tube include a first cover dimension selected to position the top edge on a person's nose above the nostrils and the bottom edge below a person's chin near a lower end of the person's neck. A first dimension of the droplet filter is preferably selected to extend the droplet filter from the dorsum of a person's nose to below the person's mouth.

DESCRIPTION

Figure 1:
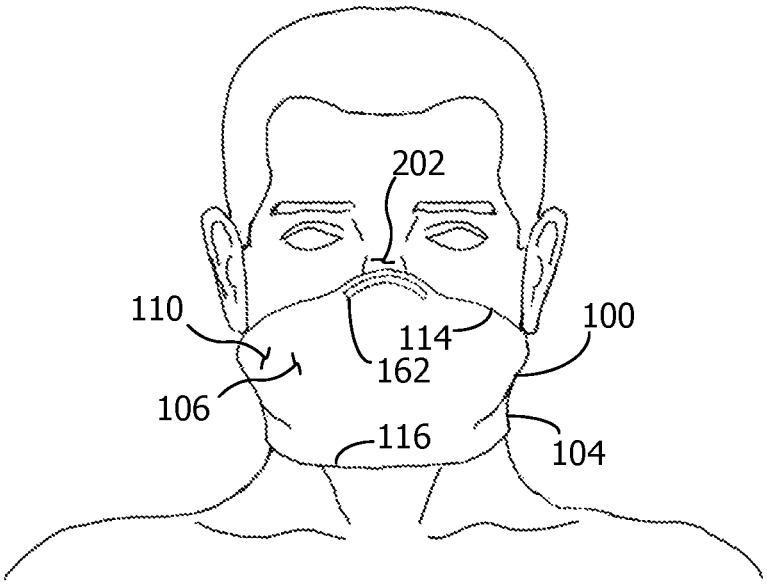
FIG. 1 shows a view toward the front of a person's face of an example of a face and neck cover in position for blocking liquid droplets entrained in air passing through the person's nose and mouth.

A face and neck cover for filtering air passing into and out of a person's mouth and nose includes a fabric tube and a droplet filter attached to an inner surface of the fabric tube. The droplet filter is positioned to cover the mouth and nose of a person wearing the face and neck cover when the top edge of the fabric tube extends onto the top of the nose and the bottom edge of the fabric tube extends below the person's chin. The droplet filter is configured for blocking airborne liquid droplets released through the nostrils and mouth by the person wearing the face and neck cover.

In some embodiments, the bottom edge of the fabric tube may be extended to reach to the base of the neck. In other embodiments, the bottom edge of the fabric tube extends just below the chin, leaving much of the neck uncovered, an arrangement that may be preferred by some people in warm weather. When not needed for reducing the spread of a pathogen to other people, for example when the person wearing the mask is alone or is able to comply with safe social distancing guidelines, the top edge of the fabric tube for the face and neck cover may be pulled down below the chin to uncover the nose and mouth without removing the face and neck cover from the neck.

Some embodiments of the face and neck cover have a fabric tube with a top edge positioned to extend over the dorsum nasi and up to the bottom of the ears, leaving the ears uncovered. The dorsum nasi refers to the external ridge of the nose between the bridge at the upper end of the nose and the apex above the nostrils. The dorsum nasi may also be referred to herein as the dorsum of the nose.

Some embodiments of the face and neck cover have a fabric tube with a top edge positioned to extend up the back of the head above the base of the skull, at least partially covering the ears. To avoid interfering with a person's hearing while wearing the face and neck cover, some face and neck cover embodiments have hearing apertures formed in the fabric tube. In some embodiments, the hearing apertures are positioned to allow the external parts of the ears to protrude through the hearing apertures. An ear cover made from an open meshwork fabric may optionally be provided over the hearing apertures to cover the ears and strengthen the fabric tube with only a small reduction in the person's hearing compared to completely uncovered ears.

Embodiments of the face and neck cover are preferably positioned for blocking liquid droplets from a person's mouth and/or nose by the person inserting their head into the central aperture of the hollow fabric tube, pulling the bottom edge of the fabric tube over the head toward the torso to below their chin, and positioning the top edge of the fabric tube on the dorsum of the nose with the droplet filter completely covering the end of the nose, nostrils, and mouth, and with the droplet filter in close contact with the skin on the face to the left and right of the nose and mouth. Placement of the fabric tube and droplet filter in the preferred position encourages inhaled and exhaled air to pass through the droplet filter rather than bypassing the droplet filter. In some embodiments, the fabric tube is made from an elastic material to encourage the face and neck cover to conform closely to the shape of the nose, mouth, and sides of the face when the fabric tube is pulled over the nose and chin.

The fabric tube and the attached droplet filter provide at least four filter layers for blocking liquid droplets entrained in air. The droplet filter is preferably formed from one continuous, uninterrupted sheet of fabric folded twice to form three filter layers. The folds are arranged to form two filter pockets, with an opening to the first filter pocket on an opposite side of the droplet filter from the opening to the second filter pocket. The first two filter layers of the droplet filter are intervening between the first filter pocket and the atmosphere outside a face and neck embodiment being worn by a person. The third layer of the droplet filter is intervening between the first filter pocket and second filter pocket, forming a droplet barrier separating the first filter pocket from the second filter pocket. The third filter layer is attached along two laterally opposite sides of the droplet filter to the first and second filter layers and to the fabric tube. The third filter layer is further attached to the fabric tube along a third side connecting the first and second sides to form a closed end of the second filter pocket, but is not connected along the third side to the first and second filter layers to avoid sealing the open end of the first filter pocket. None of the droplet filter layers are attached to the fabric tube on a fourth side opposite the third side to avoid sealing the open end of the second filter pocket.

Figure 2:
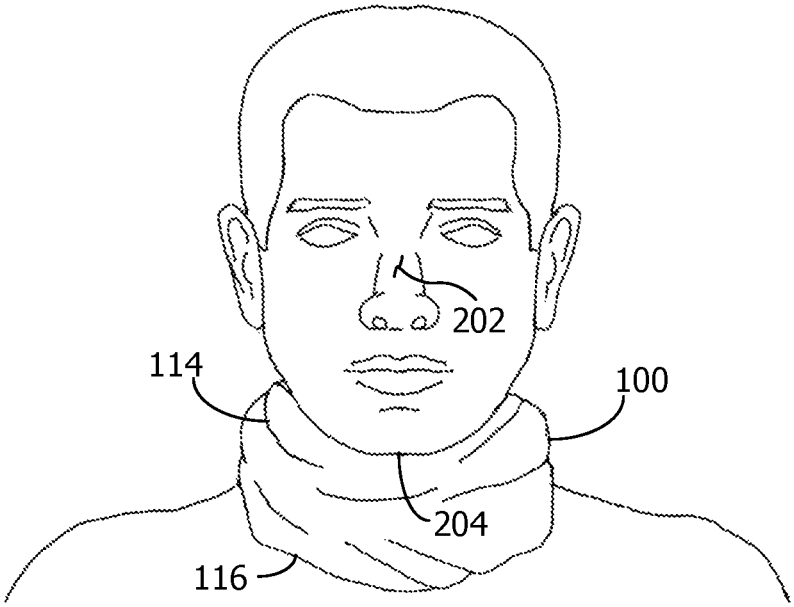
FIG. 2 shows an example of a face and neck cover pushed down from the person's nose and mouth with the top edge of the fabric tube portion of the face and neck cover below the person's chin and the bottom edge of the fabric tube at or below the lower end of the neck.

FIGS. 1 and 2 show examples of a person wearing an embodiment of a face and neck cover 100. As shown in the view toward the front side 106 and outer surface 110 of the example face and neck cover 100 in FIG. 1, the face and neck cover 100 includes a fabric tube 104 having a top edge 114 and a bottom edge 116. In all embodiments 100 described herein, the fabric tube is preferably long enough to be worn with the top edge 114 in close contact with the skin on the dorsum of a person's nose 202 and the bottom edge 116 in close contact with the skin and/or facial hair below the person's chin 204. The preferred positions of the upper and lower edges shown in FIG. 1 position a droplet filter over the person's mouth and nostrils to block liquid droplets passing out of the nose and mouth during talking, sneezing, coughing, or respiration.

Directional references used herein are given from the point of view of a person wearing an embodiment of a face and neck cover 100. For example, up refers to a direction from the person's torso toward the crown of the head, down refers to a direction toward the person's torso from the crown of the head, left refers to a direction toward the person's left hand, left arm, or left shoulder, and right refers to a direction towards the person's right hand, right arm, or right shoulder.

In the example of FIG. 2, the top edge 114 of the fabric tube 104 has been pulled downward from its position on the dorsum of the nose in FIG. 1 to another position beneath the chin 204 to uncover the nose and mouth without removing the face and neck cover 100 from the neck. When worn as shown in FIG. 2, the face and neck cover 100 is readily available for quickly and easily covering the nose and mouth, yet permits the person wearing the face and neck cover to eat, drink, expose their face to light or fresh air, or speak without the sound-muffling effect of the fabric. The arrangement of the face and neck cover 100 shown in the example of FIG. 2 is applicable to all the embodiments of a face and neck cover 100 disclosed herein.

The CDC has recommended avoiding hand contact with mask surfaces near the mouth and nose to reduce the risk of spreading infections to and from the person wearing the mask. Unlike paper or cloth dust masks using elastic ear loops to hold the mask onto the ears, the face and neck cover 100 can easily be pulled up over the mouth and nose or pulled down from covering the face without placing the hands near the nose and mouth by grasping the cover 100 along the top edge 114 near the person's ears and pulling the top edge 114 upward to cover the mouth and nose or downward to expose the nose and mouth.

Figure 3:
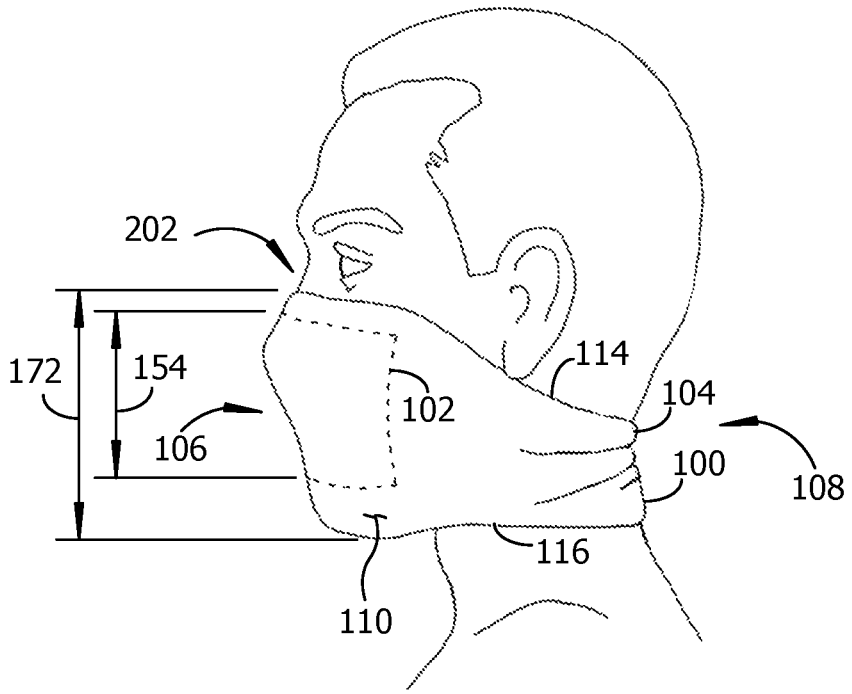
FIG. 3 shows a view toward the right side of a person's face of the example face and neck cover from FIGS. 1-2, with the fabric tube configured to cover the nose, chin, and back of the neck while leaving a substantial part of the front of the neck uncovered.

FIG. 3 shows the example face and neck cover 100 from FIGS. 1 and 2 in a view toward the left side of the person's face. In the example of FIG. 3, the fabric tube 104 forms a continuous band all the way around the face and head, covering the nose, mouth, and chin, a feature of the fabric tube common to all the face and neck cover embodiments 100 disclosed herein. The top edge 114 extends over the dorsum of the nose 202 and under the ears in the example face and neck cover 100 of FIG. 3. The bottom edge 116 passes under the chin and in the example face and neck cover 100 of FIG. 3, around the back of the neck. A separation distance of the top edge 114 and bottom edge 116 is determined by a first dimension 172 of the face and neck cover 100. In some embodiments 100, the first dimension 172 is long enough to extend the fabric tube from the dorsum of the nose to just past the chin, as shown in FIG. 3 and elsewhere. Alternatively, the first dimension 172 may be selected to place the bottom edge 116 well down the neck as shown in the examples of FIGS. 5-8. The top edge 114 may be formed with an arcuate shape to cause the top edge to rest naturally over the dorsum of the nose and under the ears. Alternatively, the fabric tube 104 may be formed with approximately parallel top and bottom edges, and the material pulled down and compressed at the back of the neck to uncover the ears as suggested by the wrinkles on the back side 108 of the face and neck cover in FIG. 3.

The droplet filter 102 is preferably attached to an inner surface 112 of the fabric tube 104 on the front side 106, to be discussed in more detail with regard to FIGS. 9-14. The droplet filter 102 is formed with a first dimension 154 sufficient for the droplet filter to completely cover the person's mouth and nostrils and extend onto the dorsum of the nose, without any part of the droplet filter extending below the chin, above the top edge 114 of the fabric tube 104, and below the lower edge 116 of the fabric tube. The first dimension 154 of the droplet filter 102 is therefore less than the first dimension 172 of the fabric tube for the disclosed embodiments 100, as illustrated in the example face and neck cover embodiments of FIGS. 3-9.

Figure 4:
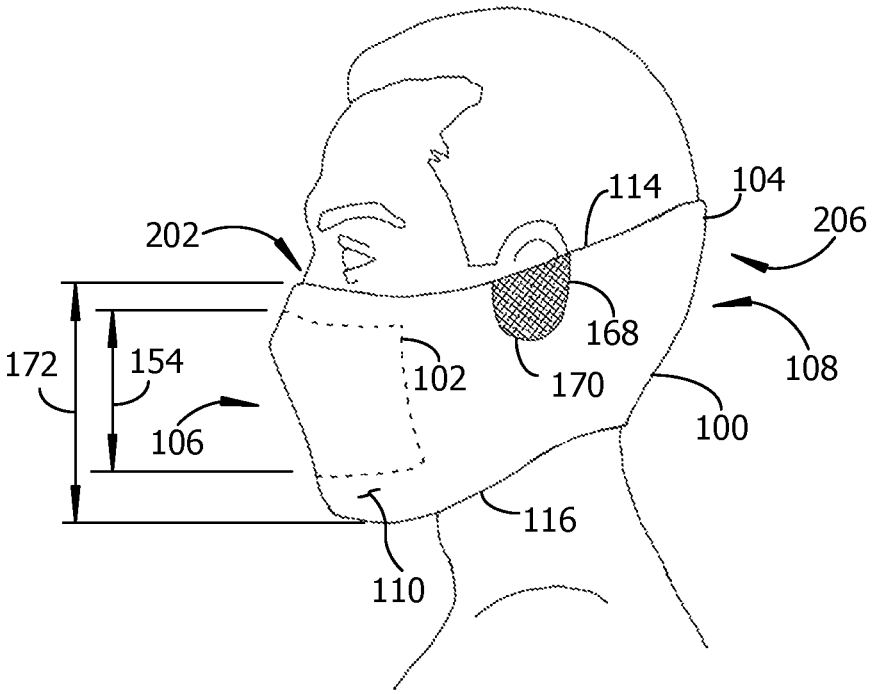
FIG. 4 shows a view toward the right side of a person's face of another example face and neck cover having hearing apertures formed in the fabric tube, optional open-mesh ear covers positioned over the hearing apertures, and the fabric tube configured to cover the nose, chin, and back of the head with most of the front and back of the neck uncovered.
Figure 11:
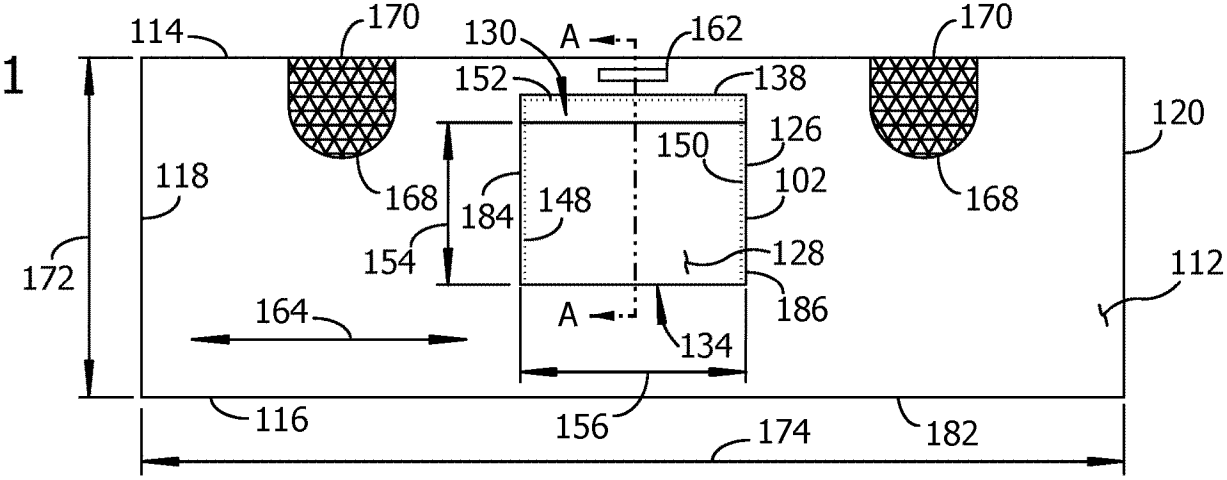
FIG. 11 shows a view toward an inner surface of the fabric tube forming the face and neck covers of the previous examples, with the fabric tube opened up along an optional tube closure and a fabric panel forming the fabric tube laid flat, and further illustrating examples of the particle filter, optional hearing apertures, and optional ear covers.
Figure 12:
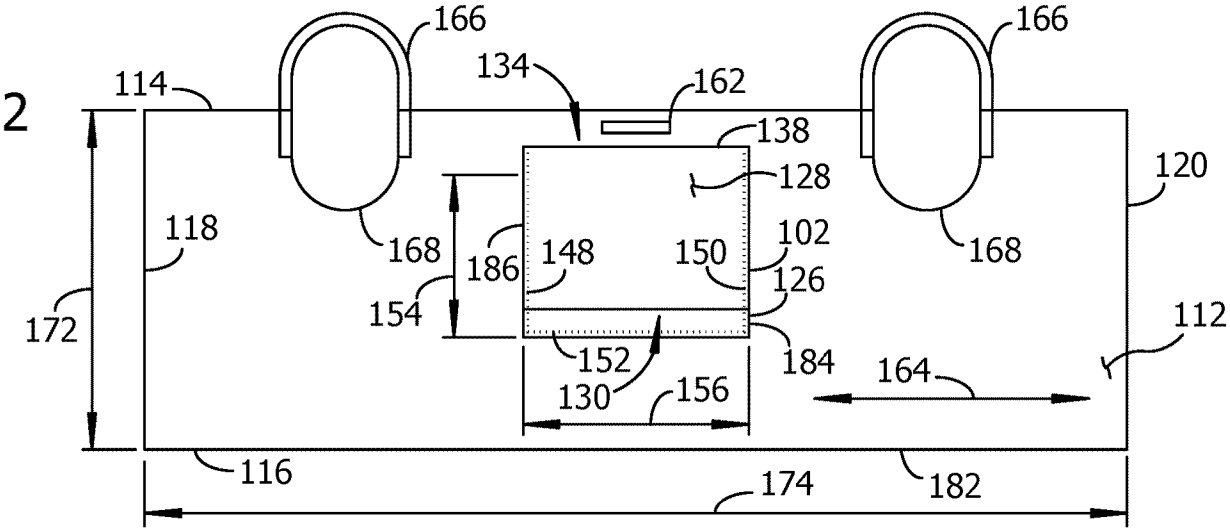
FIG. 12 shows a view toward an inner surface of the fabric tube forming the face and neck covers of the previous examples, with the fabric tube opened up along an optional tube closure and the fabric panel forming the fabric tube laid flat, and further illustrating examples of optional suspension bands above each hearing aperture and an alternative orientation of the particle filter.

The example face and neck cover 100 in FIG. 3 covers part of the back of the neck. However, as suggested in FIG. 4, the top edge 114 and bottom edge 116 of the fabric tube may optionally be shaped so that the back side 108 of the fabric tube 104 wraps around the back of the head 206, leaving most of the neck uncovered. When the fabric tube 104 extends up the back of the head as in the examples of FIGS. 4, 7, and 8, the ears may be partially or fully covered by the fabric tube. Ear apertures may therefore be formed in the fabric tube to reduce hearing impairment from covering the ears. FIG. 4 illustrates an example of an ear aperture 168 formed in the left side of the fabric tube. A second ear aperture 168 formed on the right side of the fabric tube is shown in FIGS. 11-12. The ear apertures 168 are preferably positioned on the fabric tube to avoid obstructing the person's ear canals. As suggested in the example of FIG. 4, the fabric tube 104 optionally includes ear covers 170 over each ear aperture 168. The ear covers 170 are preferably made from an open meshwork fabric, a fabric perforated with numerous relatively large holes, netting, or the like. The ear covers reduce excessive fabric stretch that may occur near the ear apertures 168 when the fabric tube is pulled over the head.

The examples of face and neck covers 100 in FIGS. 1-4 do not extend to the lower end of the neck where the neck joins the torso. In the examples of FIGS. 5-8, the first cover dimension 172 of the fabric tube 104 has been increased substantially compared to the examples of FIGS. 1-4 to place the lower edge 116 of the fabric tube 104 close to the lower end 200 of the neck. A face and neck cover 100 having a bottom edge extending to the lower end 200 of the neck improves protection against heat and cold and makes it more difficult for exhaled air to vent out the bottom of the fabric tube compared to the shorter fabric tubes shown in FIGS. 1-4.

Figure 5:
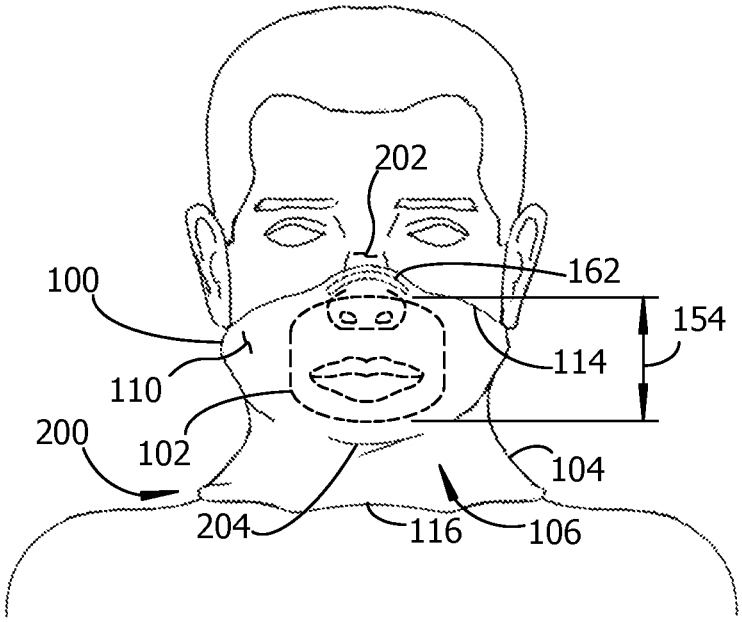
FIG. 5 shows a view toward the front of a person's face of another example of a face and neck cover having a bottom edge of the fabric tube configured to extend to the lower end of the neck, and further illustrating a preferred position over the mouth and nostrils of an example particle filter for all face and neck cover embodiments disclosed herein.
Figure 6:
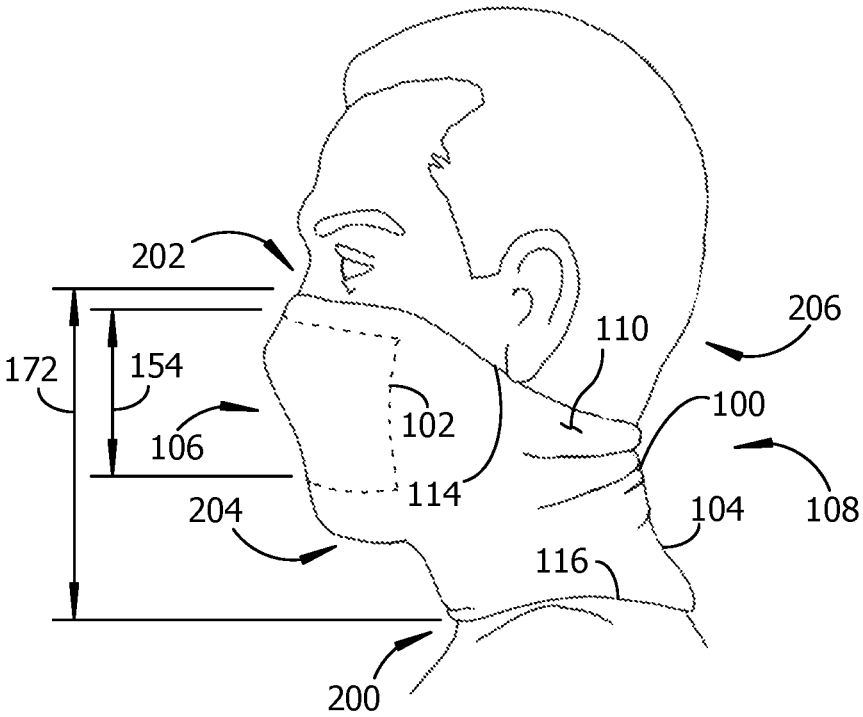
FIG. 6 shows a view toward the right side of a person's face of the example face and neck cover from 5, showing the top edge of the fabric tube extending onto the dorsum of the nose and the bottom edge reaching below the chin to the lower end of the neck.

Dashed lines in FIG. 5 illustrate an example of a preferred position of the droplet filter 102 relative to the nostrils and mouth of a person wearing the face and neck cover 100. As suggested in the example of FIG. 5, the first dimension 154 of the droplet filter 102 is preferably selected to extend the droplet filter from below the mouth to the dorsum of the nose, completely covering the mouth and nostrils and encouraging substantially all air passing out of the mouth and nostrils to enter the droplet filter, where liquid droplets entrained in the air will be blocked by the droplet filter and fabric tube. FIG. 5 further illustrates an example of a nose clip 162 affixed to the fabric tube 104. FIG. 6 continues the example of FIG. 5, showing the long fabric tube and droplet filter in a view toward the side of the person's face. The fabric tube 104 in the example of FIGS. 5-6 substantially covers the back of the neck but leaves the ears and the back of the head substantially uncovered.

Figure 7:
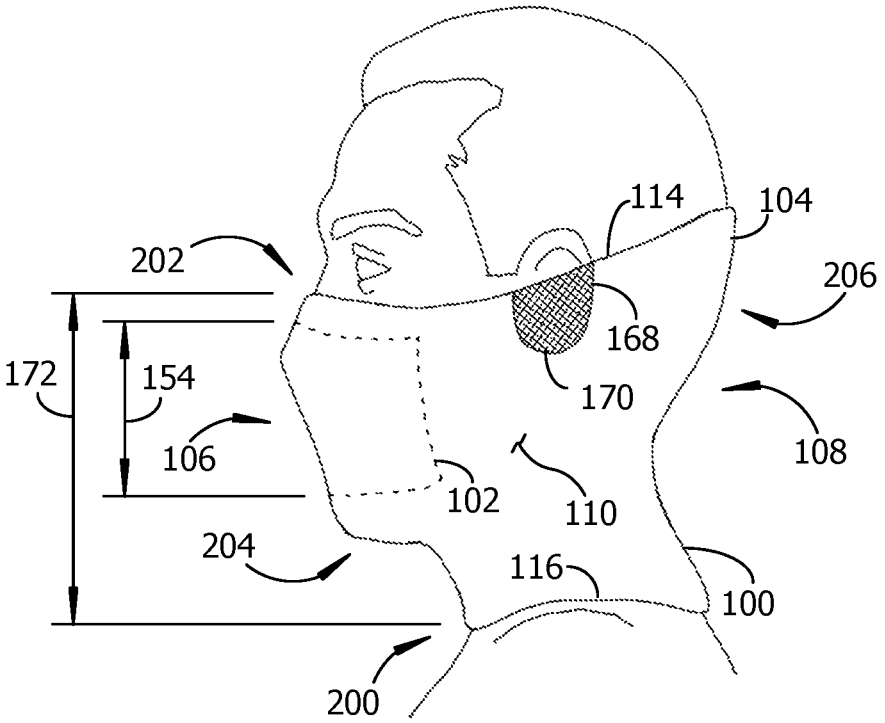
FIG. 7 shows a view toward the front of a person's face of another example of a face and neck cover having a bottom edge configured to extend to the lower end of the neck on the front and back sides of the neck and a top edge configured to extend up the back of the head past the end of the neck, at least partially covering the ears, and further showing optional hearing apertures formed in the fabric tube with optional open meshwork ear covers positioned over the hearing apertures.
Figure 8:
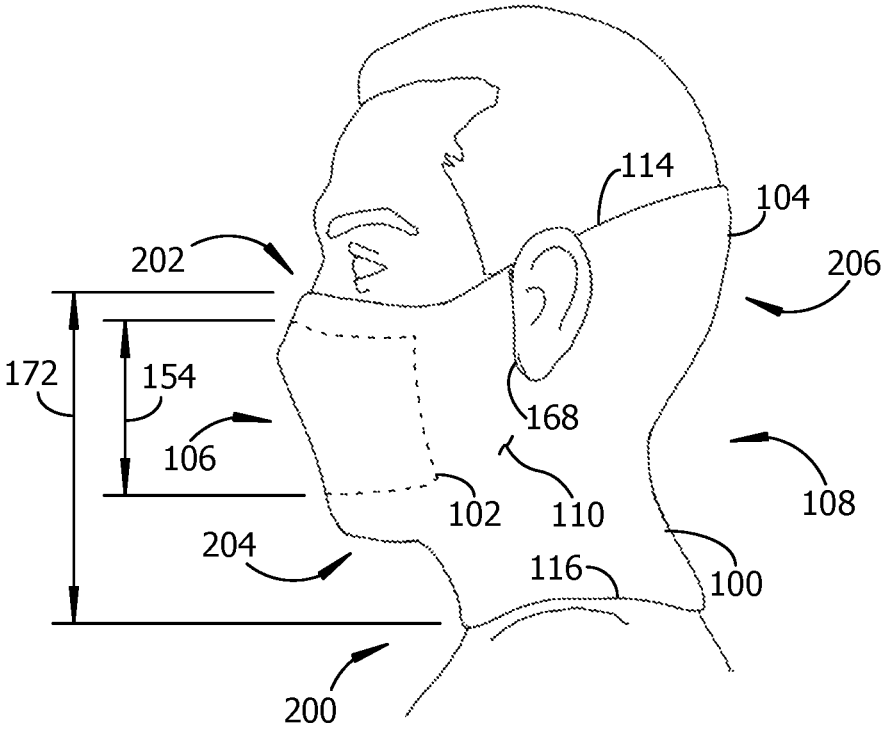
FIG. 8 is similar to the example of FIG. 7, omitting the optional open meshwork ear covers over the hearing apertures, and showing the ears extending outward through the hearing apertures formed in the fabric tube.

In the examples of FIG. 5 and FIG. 6, the fabric tube 104 is formed with a bottom edge 116 extending close to the bottom end 200 of the neck and a top edge 114 passing over the dorsum of the nose 202 and under the ears. In the examples of FIGS. 7-8, the top edge 114 of the fabric tube 104 has been shaped to extend the back side 108 of the fabric tube a substantial distance upwards onto the back of the head 206 and above the bottom of the person's ears. To prevent the fabric tube from impairing the person's hearing, ear aperture 168 have been formed in the sides of the fabric tube in the example face and neck covers 100 of FIGS. 7-8. In the example of FIG. 7, an ear cover 170 made from an open meshwork fabric has been attached to the fabric tube over the ear aperture 168. In the example of FIG. 8, ear covers 170 have been omitted from the ear apertures 168 and the ear apertures shaped to allow the ears to extend outward through the ear apertures.

Figure 9:
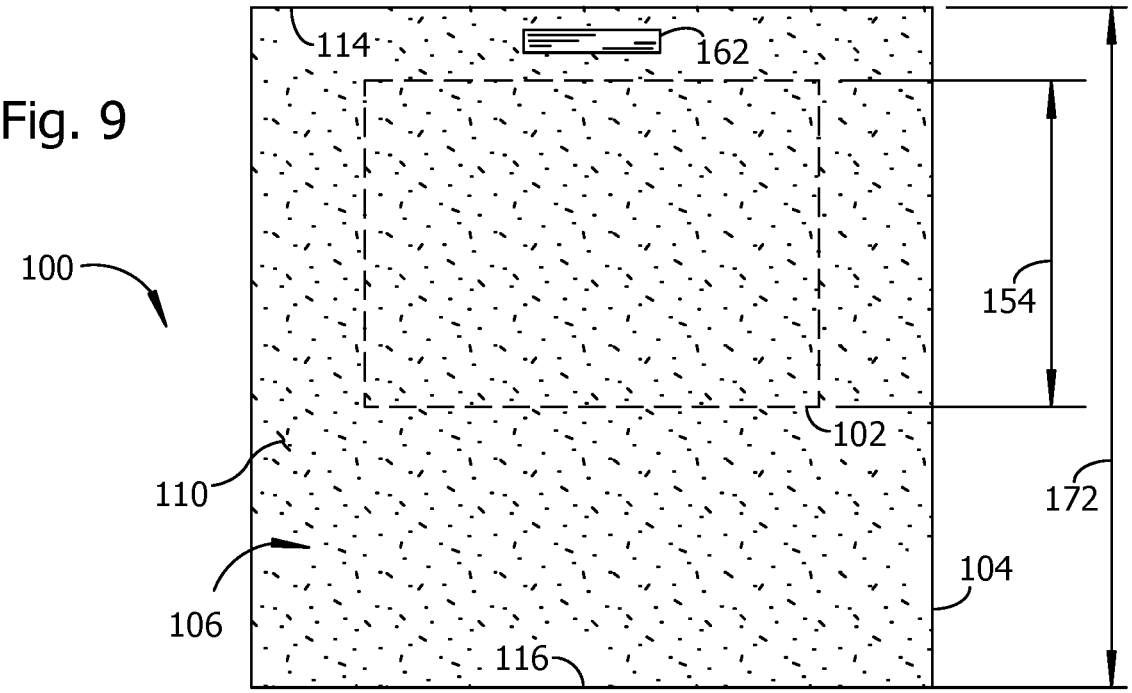
FIG. 9 shows a view toward a front side of the outer surface of the fabric tube for the example face and neck covers of FIGS. 1-8.
Figure 10:
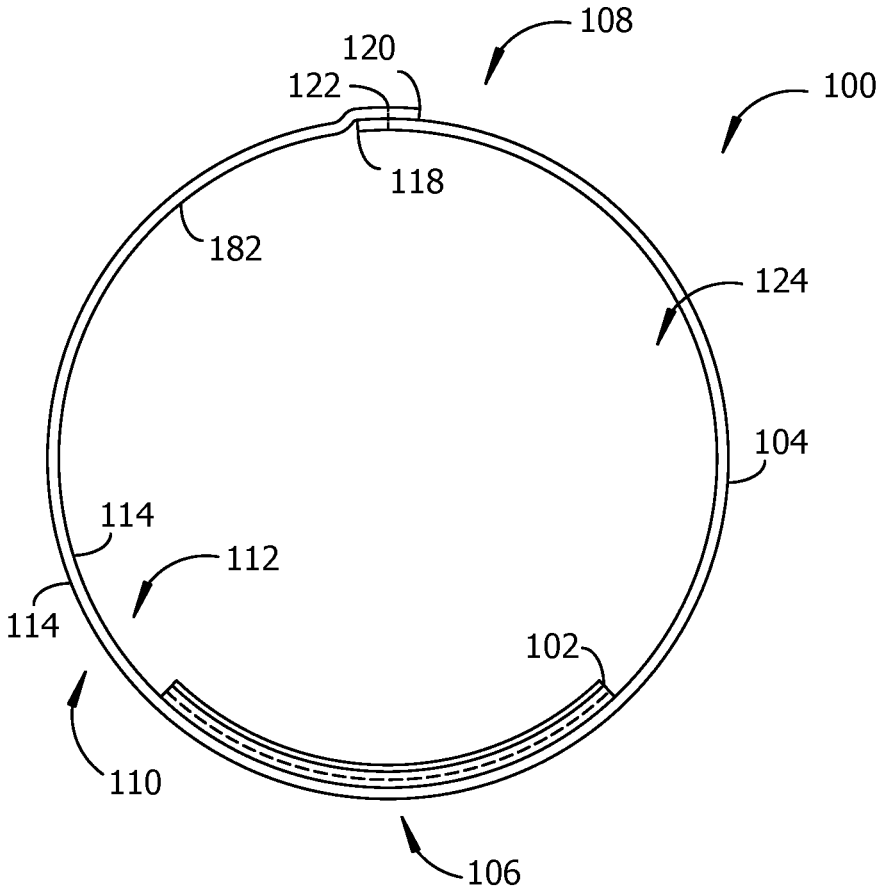
FIG. 10 shows a view toward the top edges of an example fabric tube included in the face and neck cover embodiments of FIGS. 1-9.

FIGS. 9-12 show additional details of example face and neck cover embodiments 100. FIGS. 9-10 show views of an example face and neck cover 100 having a fabric tube 104 represented in the figures with an approximately cylindrical shape. FIG. 9 shows a view toward the front side 106 of the outer surface 110 of the example face and neck cover 100. FIG. 10 shows a view toward the top edge 114 of the fabric tube and into the central aperture 124 for receiving a person's head and neck, with the example droplet filter 102 affixed to an inner surface 112 of the fabric tube. The first cover dimension 172 determines how far down a person's neck the bottom edge 116 of the fabric tube reaches when the top edge 114 is placed on the dorsum of the person's nose. The first dimension 154 of the droplet filter is preferably selected to be long enough to cover the person's mouth and nostrils, extending from below the person's mouth to the dorsum of the person's nose. The edges of the droplet filter 102, represented in FIG. 9 by dashed lines, do not extend beyond the top edge 114 and bottom edge 116 of the fabric tube 104.

In the example fabric tube 104 of FIGS. 9-10, the fabric tube includes a fabric panel 182. The fabric panel 182 has a first panel edge 118 connecting the top edge 114 to the bottom edge 116 and a second panel edge 120 connecting the top edge 114 to the bottom edge 116 at an end of the fabric panel 182 opposite the first panel edge. In the illustrated example of a face and neck cover 100, the fabric tube 104 has been formed into an approximately cylindrical shape by attaching the fabric panel 182 to itself with a tube closure adjacent the first 118 and second 120 panel edges. Examples of the tube closure 122 include, but are not limited to, stitching, adhesive, thermal fusing, a zipper, snaps, side-release buckles, complementary pieces of hook-and-loop fastener material, ties, buttons, rivets, and hooks and eyelets.

FIGS. 11-12 show examples of the fabric tube separated along the tube closure 122 with the fabric panel 182 laid flat. The view in FIGS. 11-12 is toward the surface of the fabric panel 182 corresponding to the inner surface 112 of the fabric tube 104. The fabric panel 182 may optionally be made from an elastic material to encourage the finished face and neck cover 100 to conform closely to the surfaces of the nose, chin, and sides of the face, with a direction of maximum fabric elasticity 164 preferably parallel to a longest dimension 174 of the fabric panel 182. The longest dimension 174 is preferably selected to permit a person's head to pass through the central aperture 124 of the finished fabric tube 104 while maintaining a close fit of the fabric tube to the person's nose, chin, sides of the face, and optionally against the person's neck and/or head.

The example droplet filter 102 is preferably formed from one continuous fabric panel 126 folded and attached to inner surface 112 of the fabric tube 104. The fabric panel 126 forming the droplet filter 102 is preferably folded and attached to the fabric tube so as to create three layers of filter material and two optional filter pockets for removable filter media. Forming the droplet filter 102 from one continuous fabric panel 126 reduces manufacturing cost compared to making the layers of the droplet filter from separate pieces of fabric and attaching the pieces to one another. As shown in FIGS. 11 and 12, the example droplet filter 102 is formed with the first dimension 154 selected such that an outer surface 128 of the particle filter extends from below the mouth onto the dorsum of the nose of the person wearing the face and neck cover 100. The outer surface 128 of the droplet filter 102 is the surface that contacts the face of the person wearing the face and neck cover 100. The droplet filter 102 is further formed with a second dimension 156 large enough that the outer surface 128 completely covers the person's mouth and extends onto the sides of the face.

To form the preferred arrangement of layers and filter pockets used in all the embodiments of a face and neck filter 100 disclosed herein, the droplet filter is attached to the fabric panel 182 of the fabric tube 104 along a first line of attachment 148 adjacent a first side 184 of the droplet filter and further attached along a second line of attachment 150 adjacent a second side 186 opposite the first side 184. All layers of the droplet filter are attached to one another and to the fabric tube along the first and second lines of attachment. The droplet filter 102 is further attached to the fabric tube 104 along a third line of attachment 152 adjacent a transverse edge 138 joining the first side 184 to the second side 186. Only the layer of the droplet filter in direct contact with the fabric tube is joined to the fabric tube along the third line of attachment 152. Preferably, none of the other layers of the droplet filter are attached to the fabric tube along the third line of attachment. The third line of attachment forms a transverse closed end of the first filter pocket 130, while a fold 136 in the fabric panel 126 forms a closed end of the second filter pocket 134, as explained with regard to FIGS. 13-14.

In the example of FIG. 11, the first filter pocket 130 opens toward the top edge 114 and the second filter pocket 134 opens toward the bottom edge 116. In the example of FIG. 12, the droplet filter has been rotated 180 degrees compared to FIG. 11, with the opening of the first filter pocket 130 facing the bottom edge 116 and the opening of the second filter pocket 134 facing the top edge 114.

FIGS. 11-12 further show examples of the positions of the edges of ear apertures 168 optionally formed in the fabric tube 104. In the example of FIG. 11, optional open-mesh fabric ear covers 170 are attached to the fabric tube over the ear apertures 168. The optional ear covers 170 are omitted from the ear apertures 168 in the example of FIG. 12. Suspension bands 166 may optionally be attached to the fabric tube near each ear aperture 168 as suggested in FIG. 12. The optional suspension bands 166 may contribute to the face and neck cover remaining in place over the nose and mouth while the person wearing the cover engages in vigorous activity such as running or jumping.

Figure 13:
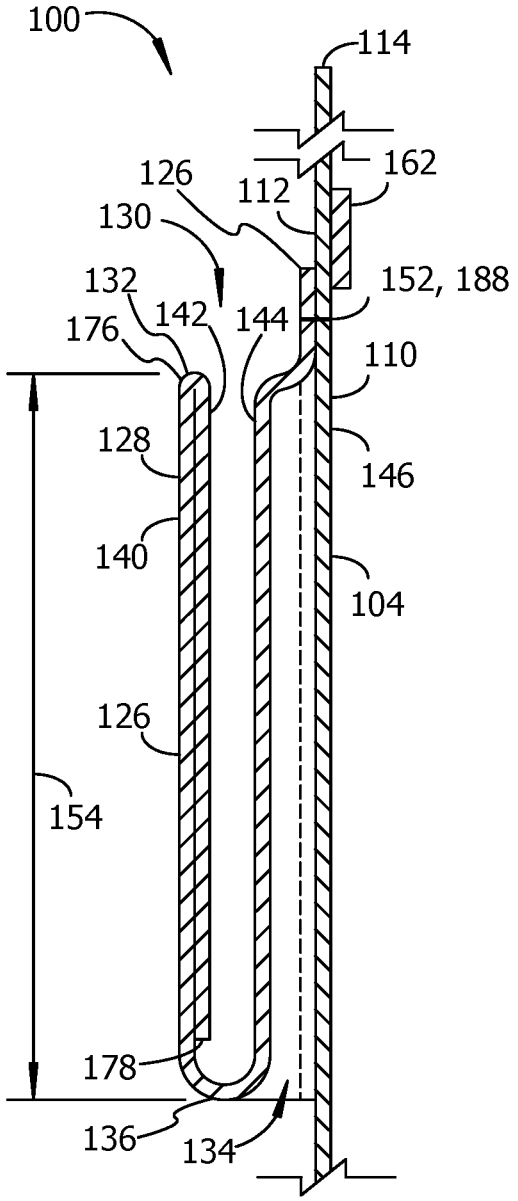
FIG. 13 shows a cross-sectional view A-A of an example of a particle filter included in all of the example embodiments of FIGS. 1-12, with the layers of a folded fabric panel forming the particle filter separated from one another to show the positions of two optional pockets for removable filter media. A location and viewing direction for cross-sectional view A-A is marked by a section line in FIG. 11.
Figure 14:
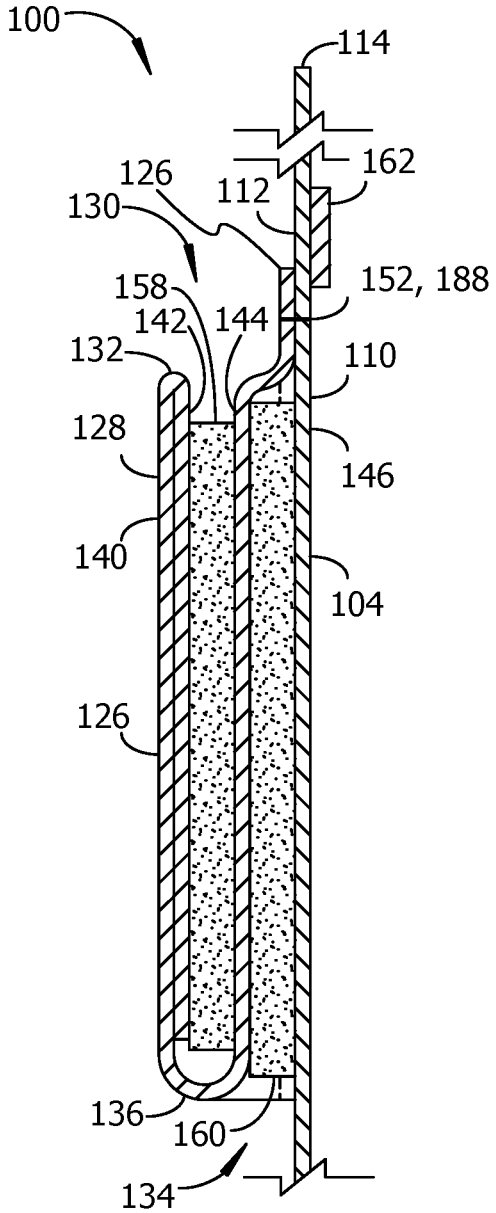
FIG. 14 is an alternative cross-sectional view A-A, adding examples of removable filter media placed in the two filter pockets of FIG. 13.

FIGS. 13-14 illustrate some details of the droplet filter 102 in cross-sectional views. FIGS. 13 and 14 apply to all the embodiments of a face and neck filter 100 disclosed herein. The droplet filter 102 is preferably formed from one continuous fabric panel 126 as previously described. The fabric panel 126 is folded along a first fold 132, forming a first filter layer 140 in contact with a second filter layer 142. A second fold 136 is positioned at an end of the first and second filter layers opposite the first fold 132, forming a third filter layer 144 extending away from the second fold 136 and toward the first fold 132, with the third filter layer 144 separated from the second filter layer 142 by the intervening void space corresponding to the first filter pocket 130. A first end 176 of the first and second filter layers corresponds to the first fold 132. A second end of the first and second filter layers corresponds to the second end 178 of the second filter layer 142. The second end 178 of the second filter layer 142 is preferably adjacent to, and optionally in contact with, the inside of the end of the first filter pocket 130 at the second fold 136. A void space between the third filter layer 144 and the fabric tube 104 corresponds to the second filter pocket 134. The portion of the fabric tube 104 adjacent the second filter pocket 134 corresponds to a fourth filter layer 146.

FIG. 13 further illustrates an example of the third line of attachment 152 positioned to form a closed end of the second filter pocket 134. An attachment means 188 joins the third filter layer 144 to the fabric tube 104 along the third line of attachment 152. Examples of attachment means 188 include, but are not limited to, stitching, rivets, thermal fusion, adhesive, snaps, and complementary pieces of hook-and-loop material. The first 140 and second 142 filter layers are attached to neither one another nor to the filter tube 104 along the third line of attachment 152, allowing the second and third filter layers to be separated from one another by the void space corresponding to the first filter pocket 132.

As shown in the example of FIG. 13, a face and neck cover embodiment 100 provides at least four layers of fabric from the droplet filter and fabric tube for trapping liquid droplets carried in air passing through the face and neck cover. More layers of filter material may optionally be provided by inserting removable filter media in each of the filter pockets. Alternate cross-sectional view A-A in FIG. 14 shows an example of a first removable filter medium 158 inserted into the first filter pocket 130 and a second removable filter medium 160 inserted into the second filter pocket 134. Examples of a removable filter medium include, but are not limited to, the same type of fabric used to make the droplet filter 102, the same type of fabric used to make the fabric tube 104, cotton wool, cotton felt, paper filter material, shrunken cotton T-shirt material prepared as recommended by the CDC, a disposable paper dust mask, and so on.

Unless expressly stated otherwise herein, ordinary terms have their corresponding ordinary meanings within the respective contexts of their presentations, and ordinary terms of art have their corresponding regular meanings.

What is claimed is:

1. An apparatus, comprising:

a fabric tube comprising an inner surface; and a droplet filter attached to said inner surface, comprising:

a first filter layer;

a second filter layer joined to said first filter layer along a first fold;

a third filter layer joined to said first filter layer along a second fold, said second filter layer intervening between said first filter layer and said third filter layer, said third filter layer in contact with said inner surface;

a first filter pocket formed between said second filter layer and said third filter layer, said first filter pocket extending from said first fold to said second fold; and a second filter pocket formed between said third filter layer and said inner surface, wherein said first, second, and third filter layers are integrally formed segments of a fabric panel.

2. The apparatus of claim 1, wherein said second fold is positioned at an end of said first filter layer opposite said first fold.

3. The apparatus of claim 1, further comprising:

said first filter layer attached to said second filter layer, said third filter layer, and said fabric tube along a first line of attachment and along a second line of attachment, said first line of attachment positioned near a first side of said droplet filter, and said second line of attachment positioned on a second side of said droplet filter laterally opposite said first side; and said third filter layer further attached to said fabric tube along a third line of attachment, said third line of attachment positioned along a side of said droplet filter connecting said first side to said second side.

4. The apparatus of claim 1, further comprising a removable filter material positioned in said first filter pocket.

5. The apparatus of claim 1, further comprising a removable filter material positioned in said second filter pocket.

6. The apparatus of claim 1, further comprising said fabric tube formed with two hearing apertures.

7. The apparatus of claim 6, further comprising two mesh fabric ear covers, one of said ear covers attached to said fabric tube over each of said hearing apertures.

8. The apparatus of claim 6, further comprising two suspension bands, one of said suspension bands attached to said fabric tube across each of said hearing apertures.

9. The apparatus of claim 1, wherein said fabric tube further comprises a top edge and a bottom edge separated from said top edge by a first cover dimension selected to position said top edge on a person's dorsum nasi and the bottom edge below a person's chin.

10. The apparatus of claim 9, further comprising said first cover dimension selected to position said top edge on a person's dorsum nasi and said bottom edge below the person's chin near a lower end of the person's neck.

11. The apparatus of claim 1, further comprising a nose clip attached to said fabric tube between said droplet filter and a top edge of said fabric tube.

12. The apparatus of claim 1, wherein a first dimension of said droplet filter is selected to extend said droplet filter from a person's dorsum nasi to below the person's mouth.

* * * * *